US007111540B2

(12) United States Patent
Rodriquez

(10) Patent No.: US 7,111,540 B2
(45) Date of Patent: Sep. 26, 2006

(54) DUAL PURPOSE PUNCHER

(75) Inventor: Humberto Rodriquez, Wabash, IN (US)

(73) Assignee: SOP Services, Inc., Las Vegas, NV (US)

( * ) Notice: Subject to any disclaimer, the term of this patent is extended or adjusted under 35 U.S.C. 154(b) by 686 days.

(21) Appl. No.: 10/453,355

(22) Filed: Jun. 3, 2003

(65) Prior Publication Data

US 2004/0244554 A1 Dec. 9, 2004

(51) Int. Cl.
*B26F 1/04* (2006.01)

(52) U.S. Cl. ..... 83/691; 83/167

(58) Field of Classification Search ..... 83/588, 83/563, 167, 618, 691, 687
See application file for complete search history.

(56) References Cited

U.S. PATENT DOCUMENTS 1,335,932 A * 4/1920 Bayles ..... 37/97
2,534,094 A * 12/1950 Yerkes ..... 83/449
3,073,199 A * 1/1963 Yerkes ..... 83/549
3,808,933 A * 5/1974 Buan ..... 83/588
4,466,322 A * 8/1984 Mori ..... 83/468
4,724,734 A * 2/1988 Hse ..... 83/549
5,012,712 A * 5/1991 Nordquist ..... 83/571
5,342,276 A * 8/1994 Fujiwara et al. ..... 483/29
5,829,334 A * 11/1998 Evans et al. ..... 83/618
5,974,929 A * 11/1999 Kugel et al. ..... 83/582
6,076,447 A * 6/2000 Damask ..... 83/618

* cited by examiner

*Primary Examiner*—Charles Goodman

(57) ABSTRACT

A dual-purpose puncher combining two-hole and three-hole punch assemblies, is shown and described. The dual purpose puncher provides a duality of uses to the consumer without the necessity for readjustment.

In the preferred embodiment, the two-hole punch assembly is positioned opposingly to the three-hole stationary punch assembly in such a way that a central arm of the press lever frame of the three-hole punch assembly passes between two arms of the press lever frame of the two-hole punch assembly.

In another embodiment, the modified press lever frame of the three-hole punch assembly slidably engages the modified press lever frame of the two-hole punch assembly thereby driving both, the punch set of the two-hole punch assembly and the punch set of the three-hole punch assembly.

Either embodiment combines both punch assemblies and a platform into a single unit while reducing the platform's footprint.

1 Claim, 2 Drawing Sheets

DUAL PURPOSE PUNCHER

TECHNICAL FIELD

The technical field of this disclosure is the punching devices, particularly, the hole punchers for sheet materials.

BACKGROUND OF THE INVENTION

Punchers are used to punch holes in paper and other sheet materials, such as cardboard, leather, fabric, plastics, and similar materials, usually in order to be able to bind these sheets in a binder. There are several different binder standards. The most popular in the US are the three-hole binders where the distance between two adjacent rings is 4.25" and the two-hole binders where the distance between binder rings is 2.75".

Numerous adjustable punchers are known to the art where the punching members are readjusted in order to switch from a three-hole punch to two-hole punch, and vice-versa. For example, in the U.S. Pat. No. 2,534,094, J. A. Yerkes discloses an adjustable paper puncher where 11 removable punch members can be inserted into all or any of the available 11 holes. In this puncher, a switching from two to three holes requires a readjustment by pulling and reinserting of the punch members.

In the U.S. Pat. No. 4,724,734, Park-Son Hse discloses a multipurpose puncher that includes a pair of one-hole stationary puncher assemblies positioned separately on a base, and a movable puncher assembly mounted slidably between these stationary assemblies. This puncher permits to switch from a single-hole punch and a two-hole punch without making any changes to a puncher. But switching from a two-hole to three-hole punch requires a readjustment.

In the U.S. Pat. No. 5,829,334, Alfred J. Evans and Balaji Kandasamy disclose another adjustable paper puncher where the switching from two to three holes requires a readjustment from the bottom of the punch by sliding the punching heads to the required punching positions.

Placing two separate punchers, a two-hole and a three-hole puncher, side-by-side on the same platform has never made any sense because such a dual purpose unit would take as much space on the desk as two separate units.

SUMMARY OF THE INVENTION

This invention fulfills the need for a small footprint combination two-and-three-hole puncher where the switch from two to three hole punching and back doesn't require any readjustment.

According to the present invention, a dual purpose puncher comprises a platform, a two-hole punch assembly, and a three-hole punch assembly. Both assemblies are substantially aligned on the platform while facing opposing directions. Thereby, the access to the two-hole puncher is from one side and to the three-hole puncher is from the other, opposing side.

A central arm of a press lever frame of the three-hole punch assembly either passes through, or engages, via an activator rib, a roller bar of the press lever frame of the two-hole punch assembly thus combining both assemblies into one single unit. By engaging both press lever frames in the above-described manner, and aligning feet of both units, a substantial footprint area is saved as compared to simply positioning two punch assemblies on the same platform.

DRAWINGS REFERENCE NUMERALS

Figure 1:
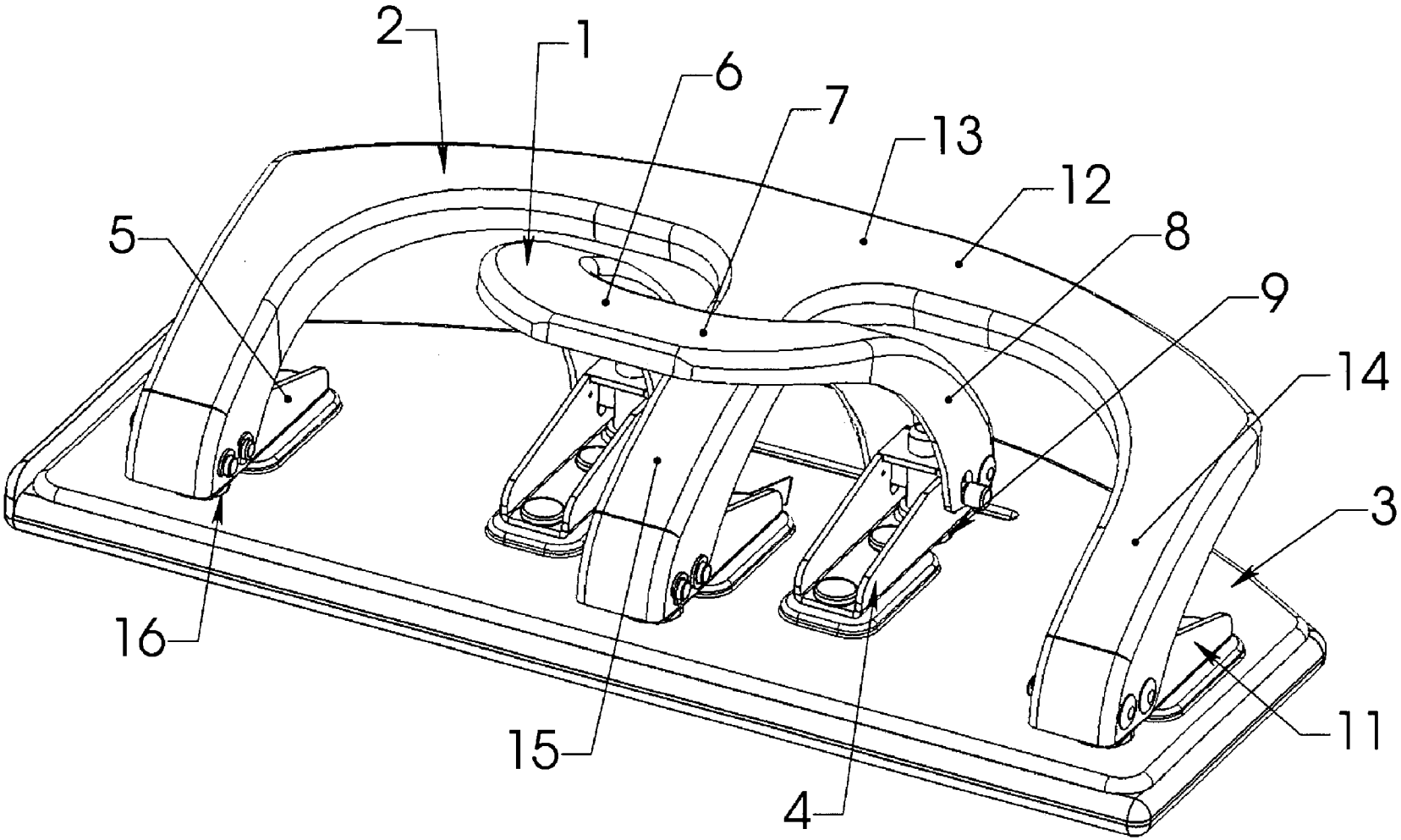
FIG. 1. is a perspective view of the preferred embodiment of the dual purpose puncher made in accordance with the present invention.

1 two-hole punch assembly
2 three-hole punch assembly
3 platform
4 support for the two-hole punch assembly
5 foot
6 press lever frame of the two-hole punch assembly
7 short press lever
8 arm
9 punch set of the two-hole punch assembly
10 punch member
11 support for the three-hole punch assembly
12 press lever frame of the three-hole punch assembly
13 long press lever
14 side arm
15 central arm
16 punch set of the three-hole punch assembly
17 modified two-hole punch assembly
18 modified three-hole punch assembly
19 modified press lever frame of the two-hole punch assembly
20 auto-activated short press lever
21 short arm
22 roller
23 modified press lever frame of the three-hole punch assembly
24 modified central arm
25 activator rib

DESCRIPTION OF THE PRESENTLY PREFERRED EMBODIMENT

FIG. 1 shows the preferred embodiment of the dual purpose puncher made in accordance with the present invention. A two-hole punch assembly 1 and a three-hole punch assembly 2 are fixedly disposed on a platform 3. The two-hole punch assembly 1 stands on a support for the two-hole punch assembly 4 comprised of two feet 5 fixedly disposed on the platform 3. A press lever frame of the two-hole punch assembly 6 integrates into one part a short press lever 7 and two arms 8 supporting the short press lever 7, each of the arms 8 pivotably disposed on each of the feet 5. A punch set of the two-hole assembly 9 is comprised of two punch members 10, each pivotably disposed on each of the two arms 8. The punch set of the two-hole punch assembly 9 is drivable by the press lever frame of the two-hole punch assembly 6 which urges the punch set of the two-hole punch assembly 9 to slide up and down.

A support for the three-hole punch assembly 11 is comprised of three feet 5 fixedly disposed on the platform 3. A press lever frame of the three-hole punch assembly 12 integrates in one part a long press lever 13, two side arms 14 and a central arm 15, all three arms supporting the long press lever and each of the three arms pivotably disposed on each of the three feet 5. A punch set of the three-hole punch assembly 16 comprises three punch members 10, each of these three punch members pivotably disposed on each of the side arms 14 and the central arm. The punch set of the three-hole punch assembly 16 is drivable by the press lever frame of the three-hole punch assembly 12 urging it to slide up and down.

The central arm 15 of the press lever frame of the three-hole punch assembly 12 passes between two arms 8 of the press lever frame of the two-hole punch assembly 6, whereby visually combining these two punch assemblies and the platform 3 into a single unit while reducing the platform's footprint thereby utilizing the desk space in the most efficient manner.

Figure 2:
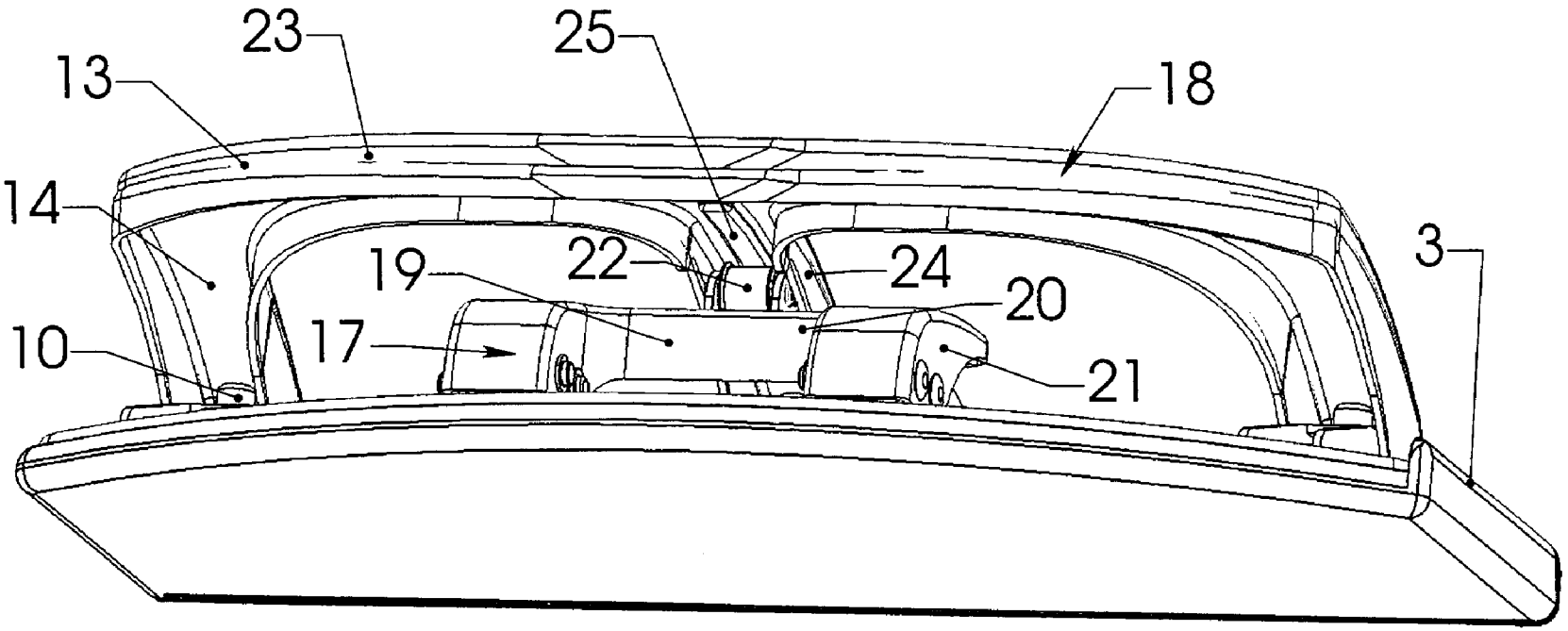
FIG. 2. is a perspective view of another embodiment of the dual purpose puncher made in accordance with the present invention.

FIG. 2 shows another embodiment of the dual purpose puncher made in accordance with the present invention. A modified two-hole punch assembly 17 and a modified three-hole punch assembly 18 are fixedly disposed on the platform 3. A modified press lever frame of the two-hole punch assembly 19 integrates into one part an auto-activated short press lever 20 and with two short arms 21. A roller 22 is pivotably disposed on the auto-activated short press lever 20.

A modified press lever frame of the three-hole punch assembly 23 integrates into one part the long press lever 13, the side arms 14, and a modified central arm 24. An activator rib 25 stretches along the inner side of the modified central arm 24.

When the modified press lever frame of the three-hole punch assembly 23 is depressed, the activator rib 25 engages the roller 22 pushing downward the modified press lever frame of the two-hole punch assembly 19 urging all five punch members 10 to slide up and down. It should be clear to anyone skilled in the art that a similar arrangement is possible where the short press lever is positioned above the long press lever and hand-activated, and the long press lever is positioned below the short press lever and auto-activated.

This arrangement mechanically combines the modified two-hole punch assembly 17 and the modified three-hole punch assembly 18 into a single unit while reducing the platform's footprint thereby utilizing the desk space in the most efficient manner.

The invention claimed is:

1. A dual-purpose puncher is claimed comprising:

a platform, a two-hole punch assembly, the two-hole punch assembly fixedly disposed on said platform, said two-hole punch assembly comprising, a support for the two-hole punch assembly, a punch set of the two-hole punch assembly, and a press lever frame of the two-hole punch assembly, the press lever frame of the two-hole punch assembly comprising a short press lever supported by two arms;

a three-hole punch assembly, the three-hole punch assembly fixedly disposed on said platform opposingly to said two-hole punch assembly, said three-hole punch assembly comprising:

a support for the three-hole punch assembly, a punch set of the three-hole punch assembly, and a press lever frame of the three-hole punch assembly, the press lever frame of the three-hole punch assembly comprising a long press lever supported by two side arms and a central arm, said central arm disposed between said two arms of said press lever frame of the two-hole punch assembly, whereby visually comprising said two-hole punch assembly and said three-hole punch assembly into a single unit while substantially reducing said platform's footprint.

* * * * *